US006336407B1

(12) United States Patent
Adimari et al.

(10) Patent No.: US 6,336,407 B1
(45) Date of Patent: Jan. 8, 2002

(54) PYROTECHNIC SLIDE ASSEMBLY

(75) Inventors: Louis J. Adimari, Montague, NJ (US); Keith R. Fulton, Stroudsburg, PA (US); Joseph A. Donini, Dover, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/570,954

(22) Filed: May 15, 2000

Related U.S. Application Data

(60) Provisional application No. 60/181,496, filed on Feb. 10, 2000.

(51) Int. Cl.[7] ..... F42C 15/20
(52) U.S. Cl. ..... 102/259
(58) Field of Search ..... 102/259, 202, 102/254

(56) References Cited

U.S. PATENT DOCUMENTS

| | | | | | |
|---|---|---|---|---|---|
| 3,985,075 | A | * | 10/1976 | Kulesza et al. | 102/429 |
| 4,811,664 | A | * | 3/1989 | Levy et al. | 102/226 |
| 5,022,325 | A | * | 6/1991 | Skowasch et al. | 102/226 |
| 5,046,424 | A | * | 9/1991 | Skowasch et al. | 102/226 |
| 5,387,257 | A | * | 2/1995 | Tari et al. | 102/226 |

* cited by examiner

*Primary Examiner*—Peter M. Poon
*Assistant Examiner*—Jordan Lofdahl
(74) *Attorney, Agent, or Firm*—John F. Moran; Michael C. Sachs

(57) ABSTRACT

A fuze operates in two modes. In a primary mode, the fuze functions similarly to a conventional M223 fuze. In a secondary, self-destruct mode, a pyrotechnic delay mechanism is initiated. The slide assembly is comprised of an aerodynamic safety release, a safety pin, a rotational firing pin fitted with a resilient member such as a spring, a M55 detonator, pyrotechnic initiator, a pyrotechnic delay mix and end cap. In use, the fuze is fitted to a grenade. As the grenade is dispensed from its carrier, a grenade stabilizer starts to oscillate. The oscillation results in an arming screw and an inertial weight to back out from a slide assembly, allowing the slide assembly to move to an in-line position relative to a main M55 detonator in-line with the arming screw (firing pin). Concurrently, the aerodynamic safety release is lifted in the upward direction under the force of the airstream, releasing the safety pin. This releases the rotational firing pin, which forces the rotational firing pin to contact the pyrotechnic initiator. The pyrotechnic delay mix burns to the end cap which propagates to the M55 detonator. The initiation of the main detonator causes the fuze to function in the primary mode or, if for any reason the primary mode fails to function the grenade, the grenade is rendered safe to handle by the secondary mode.

13 Claims, 7 Drawing Sheets

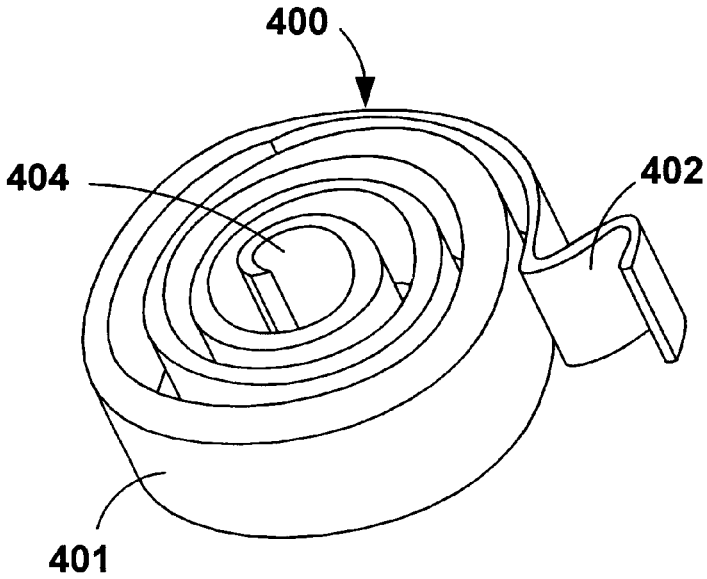
FIG. 8
FIG. 9
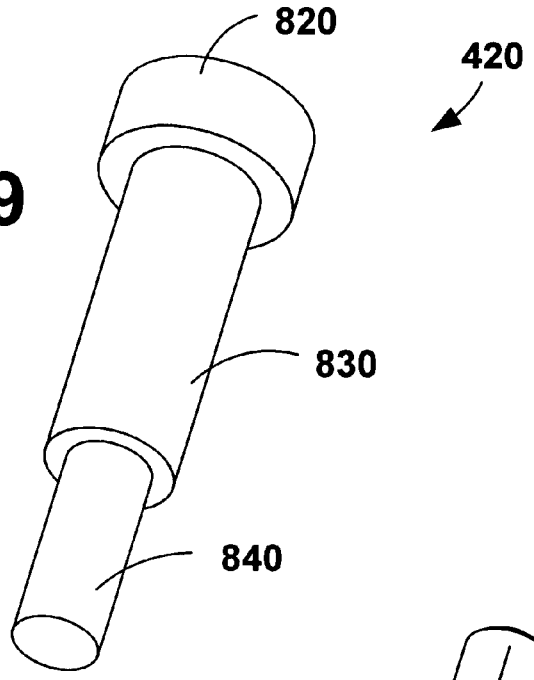
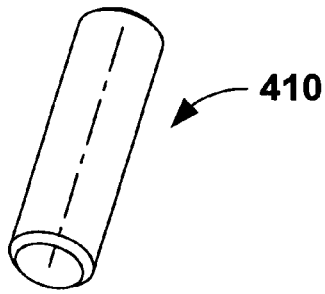
FIG. 10

PYROTECHNIC SLIDE ASSEMBLY

CROSS-REFERENCE TO RELATED APPLICATION

This application claims the priority of co-pending U.S. provisional application Ser. No. 60/181,496, filed on Feb. 10, 2000, which is incorporated herein by reference.

This application also relates to co-pending U.S. patent application titled "Self Destruct Fuze with Improved Slide Assembly", Ser. No. 09/511,641, filed on Feb. 22, 2000, which, in turn, claims the priority of U.S. provisional application Ser. No. 60/128,431, filed on Apr. 5, 1999, both of which are commonly assigned to the same assignee as the present invention, and are incorporated herein by reference.

GOVERNMENT INTEREST

The invention described herein may be manufactured and used by or for the Government of the United States for governmental purposes without the payment of any royalties thereon.

FIELD OF THE INVENTION

The present invention relates to the field of munitions, and more particularly to an improved design for a secondary self-destruct fuze that functions in the event the primary fuze mode fails to function, and that meets the design requirements for low cost, highly producible, and a non-spin/low velocity operating environment.

BACKGROUND OF THE INVENTION

Dual Purpose Improved Conventional Munitions (DPICM) must have either a self-destruct capability or they must show dud rates not to exceed 1 in 500 as an operational requirement. To this end, several engineering studies were undertaken in an attempt to address the low reliability of the conventional M223 mechanical fuze. However, these studies did not change the basic design of the M223 mechanical fuze. Instead, they generally considered modifying the materials and the manufacturing processes to reduce the dud rate problem.

Conventional designs proposed the development of a hybrid electromechanical fuze which is relatively complex with approximately 40 to 50 parts, with a costly production line. In addition, the no-spin/low velocity operational environments of grenades jeopardize the fuze reliability. Several projectiles have unique operational requirements that the current fuze design might not meet readily.

Some of the concerns facing current self-destruct fuze designs are listed below:

(1) The threads between the arming screw and the weight can be overtorqued.

(2) The fuze components may suffer collateral damage during ejection from the carrier.

(3) The fuze may impact the ground at oblique angles and the firing pin might not provide sufficient energy to the detonator.

(4) The fuze may operate poorly in a no-spin/low velocity environment.

Therefore, there is a still unsatisfied need for a fuze which, among other features, solves the no-spin/low velocity environment, significantly reduces the number of components, improves producibilty, and increases the operational reliability of the primary arming mode.

Several engineering studies were conducted in the past two decades in an attempt to address the low reliability of existing mechanical fuzes. Although these 'mechanical only' solutions did improve the overall functional reliability of the fuze, there is still room for an improved design that fully addresses the no-spin/low velocity operational environment, and that significantly reduces the dud rate to the present ordnance requirements for self destruct fuzing of grenades.

A design that proposes a secondary self-destruct electrical mode of operation is described in U.S. Pat. No. 5,387,257. While the patented fuze provides an improvement in the relevant field, the activation of this self-destruct mode requires forces that are not available from non-spin/low velocity environment. In addition, it's high cost makes it unaffordable.

SUMMARY OF THE INVENTION

The present invention contemplates an improved design for a secondary self-destruct fuze that functions in the event the primary fuze mode fails to function, and that meets the design requirements for low cost, highly producible, and a non-spin/low velocity operating environment.

The fuze offers several features and advantages, among which are the following:

(1) It significantly improves the performance of traditional M223 mechanical fuzes by providing a redundant mode of operation, which adds a self-destruct capability and leads to a tactical destruction of the grenade at impact angles greater than 60 degrees relative to the vertical, on all types of terrain.

(2) It significantly simplifies conventional designs and the production process. It uses the main firing mode of the M223 fuze, and adds a few components to the M223 fuze, to add a relatively simple secondary mode of operation through a back up independent firing pin. These additional components can be made of readily available materials that are fabricated for example, by means of stamping, die casting, or precision molding techniques.

(3) It solves the functional reliability problems when operating in a no-spin/low spin environment.

(4) It uses a unique low cost mechanical/pyrotechnic design to provide a high functional reliability, in almost all operating environments. It uses a unique aerodynamic safety release (ASR) to function the secondary mode feature providing self-destruct fuzing capability.

(5) It meets all MIL-STD-1316D standards.

(6) It is compatible with almost all grenade configurations.

(7) It provides a self destruct delay of between 30–45 seconds.

The foregoing and other features and advantages of the present invention are realized by a fuze that includes an improved slide assembly that incorporates a pyrotechnic delay mechanism with a minimum number of components. The fuze operates in two modes. In a primary mode, the fuze can function similarly to a conventional M223 fuze. In a secondary, self-destruct mode, a pyrotechnic delay mechanism is initiated. The slide assembly is comprised of an aerodynamic safety release (ASR), a safety pin, a rotational firing pin fitted with a resilient member such as a spring, an M55 detonator, a pyrotechnic initiator, a pyrotechnic delay mix and an end cap.

In use, the fuze is fitted to a munition or grenade. As the grenade is dispensed from its carrier, a grenade stabilizer starts to oscillate and sense drag. The oscillation and drag results in an arming screw and an inertial weight to back out from a slide assembly, allowing the slide assembly to move to an in-line position relative to a main M55 detonator in-line with the arming screw (firing pin). Concurrently, the unique aerodynamic safety release is lifted in the upward direction under the force of the airstream, releasing the safety pin. This releases the rotational firing pin, which forces the rotational firing pin to contact the pyrotechnic initiator.

The pyrotechnic delay mix burns to the end cap and propagates to the M55 detonator. The initiation of the M55 detonator causes the fuze to function in the primary mode or, if for any reason the primary mode fails to function the grenade, the grenade is rendered safe to handle by the secondary mode.

BRIEF DESCRIPTION OF THE DRAWINGS

The various features of the present invention and the manner of attaining them will be described in greater detail with reference to the following description, claims, and drawings, wherein reference numerals are reused, where appropriate, to indicate a correspondence between the referenced items.

FIG. 8 is an enlarged perspective view of a rotational firing spring forming part of the slide assembly of FIGS. 4 and 5;

FIG. 9 is an enlarged perspective view of a pivot pin that supports the rotational firing pin of FIG. 7 and the rotational firing spring of FIG. 8, for containing the rotation of the rotational firing pin;

FIG. 10 is an enlarged perspective, view of a pin that forms part of the rotational firing pin of FIG. 7, used to lock the rotational firing spring of FIG. 8 in position.

As used herein, the directional terms, such as "upright", "longitudinal", lateral, and so forth do not imply absolute directions, but rather connote that an angular disposition exists between the related components.

DETAILED DESCRIPTION OF THE INVENTION

Figure 1:
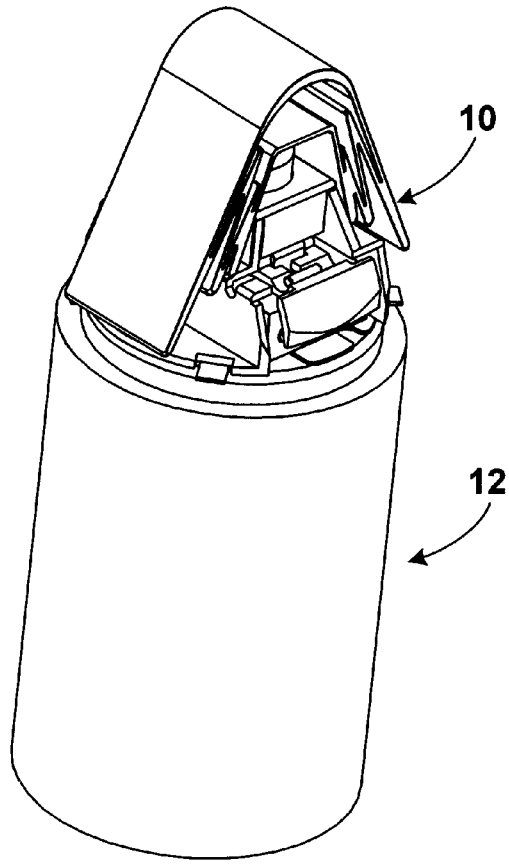
FIG. 1 is a perspective view of a fuze incorporating an improved slide assembly according to the present invention, shown secured to a grenade or munition.
Figure 2:
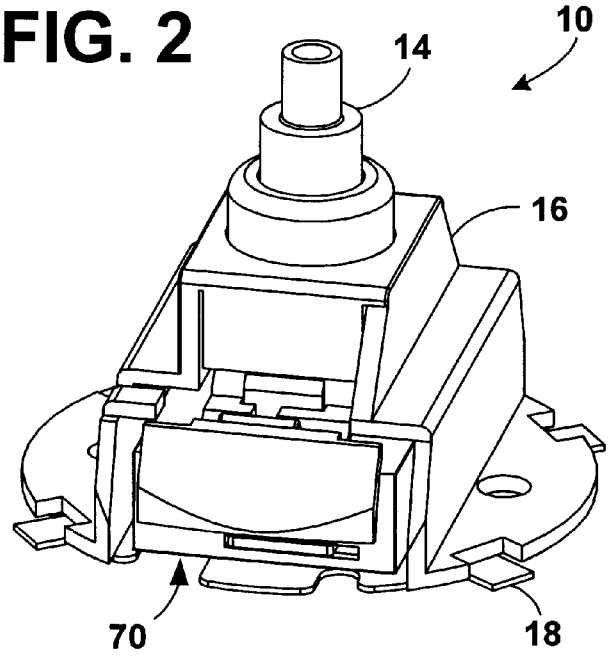
FIG. 2 is an enlarged perspective view of the fuze of FIG. 1

FIG. 1 illustrates a fuze 10 according to the present invention shown secured to a grenade 12. With reference to FIG. 2, the fuze 10 generally includes an arming screw and weight assembly 14, a housing 16, a cover 18, and a slide assembly 70. In an unarmed condition, the slide assembly 70 is secured to the housing 16 and the cover 18. In an armed condition, the slide assembly 70 moves between the housing 16 and the cover 18.

The fuze 10 operates in two modes: a primary mode and a secondary mode. In the primary mode, the fuze functions similarly to a conventional M223 fuze. The slide assembly 70 is spring-loaded from below, and in a primary mode, when it is released by the fuze safety system and free to move, it places a main detonator 19 (FIG. 3) in line between a main firing pin (combined with the arming screw of the fuze 10), and an opening 25 in the cover 18. This will expose a main charge of the grenade 12 to the action of the main firing pin and the detonator.

Figure 3:
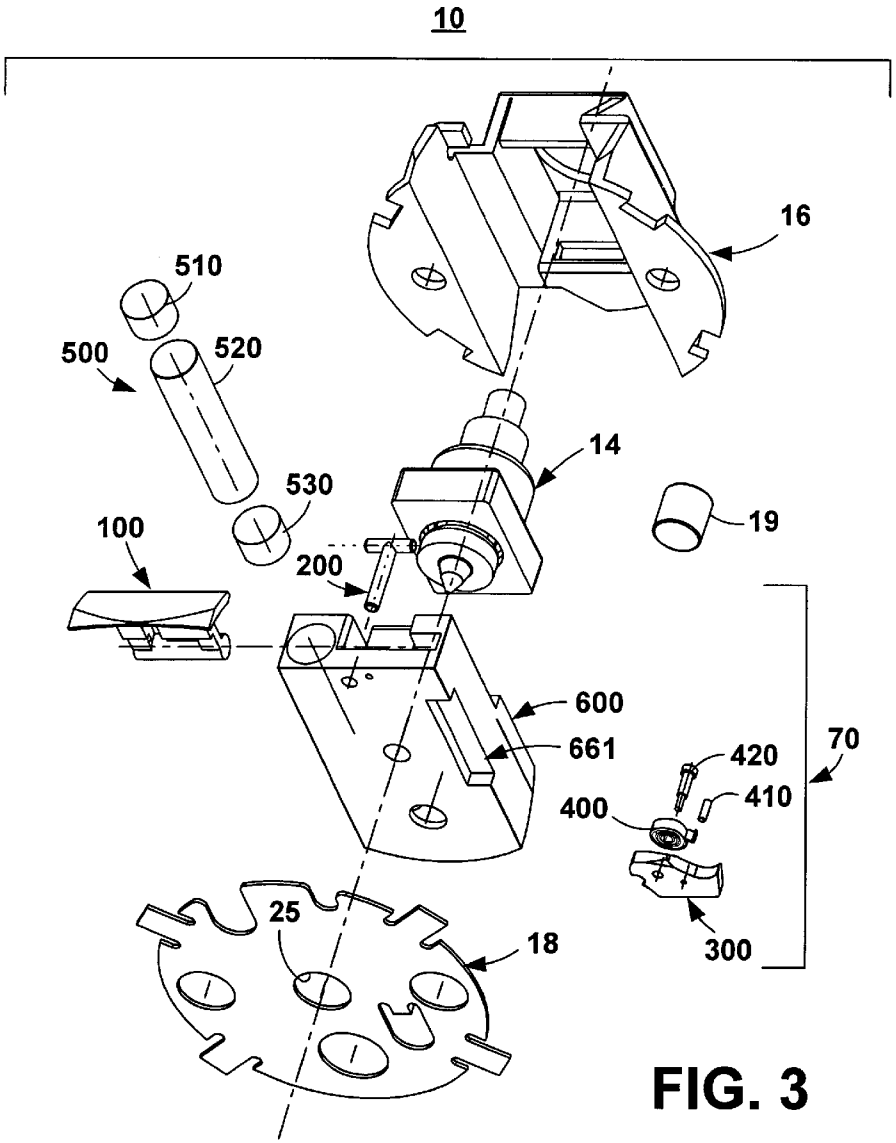
FIG. 3 is an exploded view of the fuze of FIGS. 1 and 2.
Figure 4:
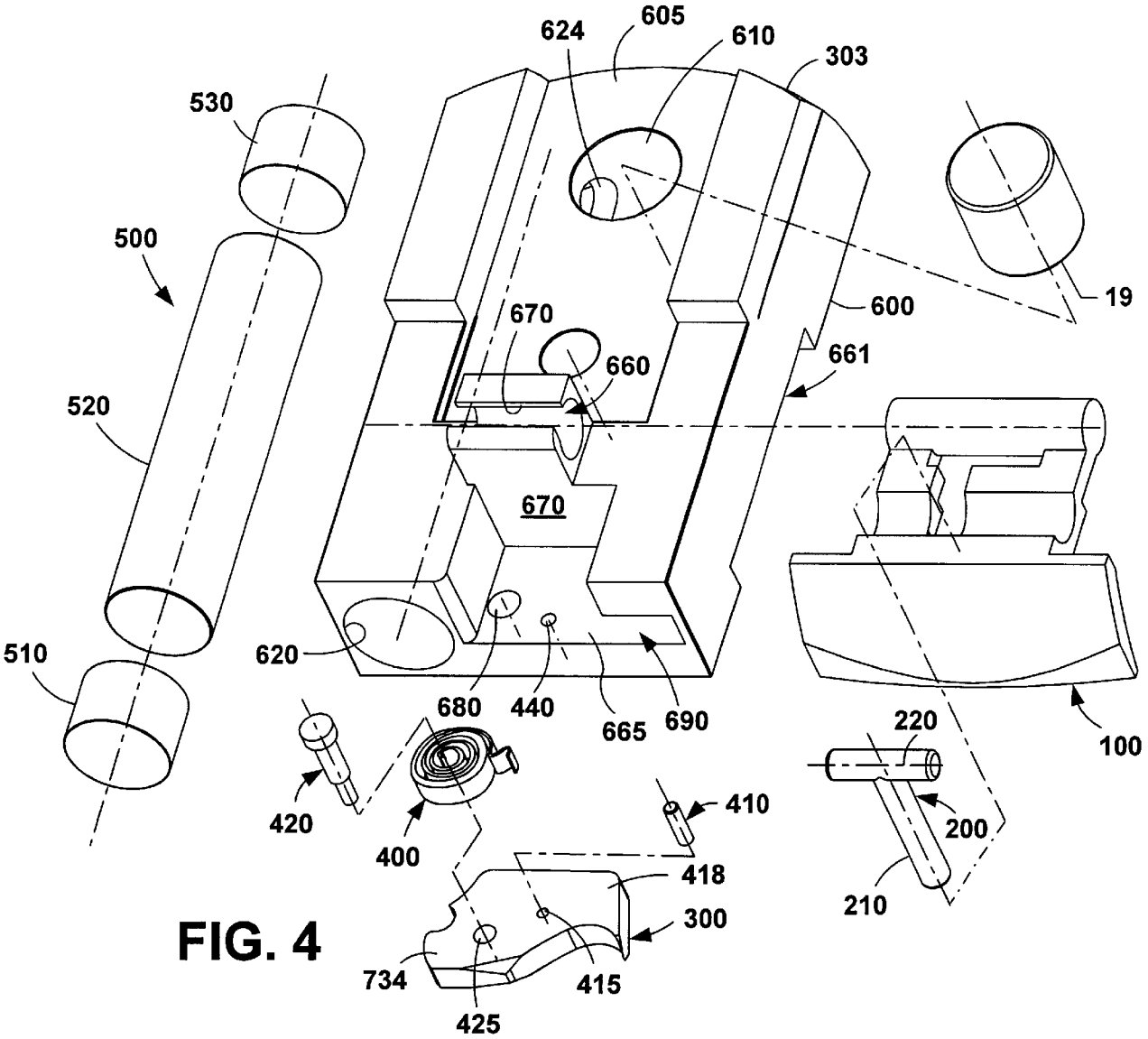
FIG. 4 is a perspective view of the slide assembly of FIGS. 1–3, shown unassembled.
Figure 7:
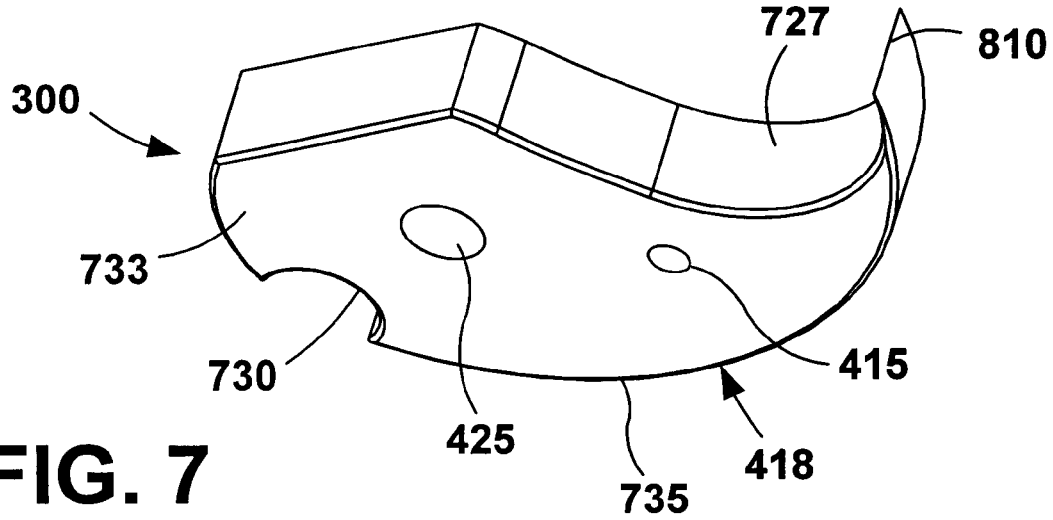
FIG. 7 is an enlarged, perspective, bottom view of a rotational firing pin forming part of the slide assembly of FIGS. 4 and 5.

With reference to FIGS. 3 and 4, the slide assembly 70 is comprised of an aerodynamic safety release (ASR) 100, a safety pin 200, a rotational firing pin 300 fitted with a spring 400, and a pyrotechnic delay mechanism 500. The spring 400 is attached to the rotational firing pin 300 by means of a spiral pin 410. With further reference to FIG. 7, the spiral pin 410 is force fitted through a hole 415 formed in the body 418 of the rotational firing pin 300. A pivot pin 420 is inserted along the center of the rotational firing pin 300 through a hole 425. The pivot pin 420 passes through the center of the spring 400 and then through the hole 425 of the rotational firing pin 300, and is force fitted into a hole 440 at the bottom of the slide 600.

The aerodynamic safety release 100 is preferably made of, for example, polycarbonate, using an injection molding process. The safety pin 200 can be made of metal, using a corrosion resistant steel. The rotational firing pin 300 is made of metal, using a corrosion resistant steel. The spring 400 of the rotational firing pin 300 is formed of resilient material.

The pyrotechnic delay mechanism 500 is comprised of an initiator 510, a pyrotechnic delay mix 520, and an end cap 530. The initiator 510 is made of match tip material or miniature detonator, and receives the initial stimulus from the rotational firing pin 300 in order to initiate the delay pyrotechnic mix 520. The pyrotechnic delay mix 520 can be made of a conventional or available composition, and is designed to burn at a rate of approximately 1 inch per 40 seconds, to initiate the end cap 530. The end cap 530 will detonate when exposed to the burning pyrotechnic delay mix 520, and, in turn, initiates the main detonator 19.

The slide assembly 70 includes a slide 600 which is preferably made of polycarbonate, using an injection molding process. The slide 600 includes several features and accommodates the remaining components of the slide assembly 70.

In use, the fuze 10 is fitted to a munition such as the grenade 12. As the grenade 12 is dispensed from its carrier (not shown), a grenade stabilizer (not shown) starts to oscillate and sense drag. This oscillation and drag causes the arming screw and weight assembly 14 to back out from both the housing and the slide assembly, allowing the slide assembly 70 to move to an in-line position relative to the center axis of the grenade and fuze and also in-line with the main detonator of the fuze. Concurrently, the aerodynamic safety release 100 is lifted in the upward direction under the force of the airstream, releasing the safety pin 200. This releases the rotational firing pin 300, which rotates until it strikes the pyrotechnic initiator 510, which, in turn, ignites the pyrotechnic delay mix 520.

The pyrotechnic delay mix 520 continues to burn for a prescribed time, until it initiates the end cap 530, which causes the main detonator 19 to detonate. If the slide assembly 70 is released and moves to the fully armed position, then the pyrotechnic delay mix 520 results in the initiation of the main detonator 19 and the functioning of the grenade 12.

However, if the primary arming mode fails and the slide assembly 70 does not move to the fully armed position, but rather remains in the unarmed position, the pyrotechnic delay mix 520 still initiates the main detonator 19 and results in the sterilization of the grenade 12, rendering it safe to handle.

Figure 5:
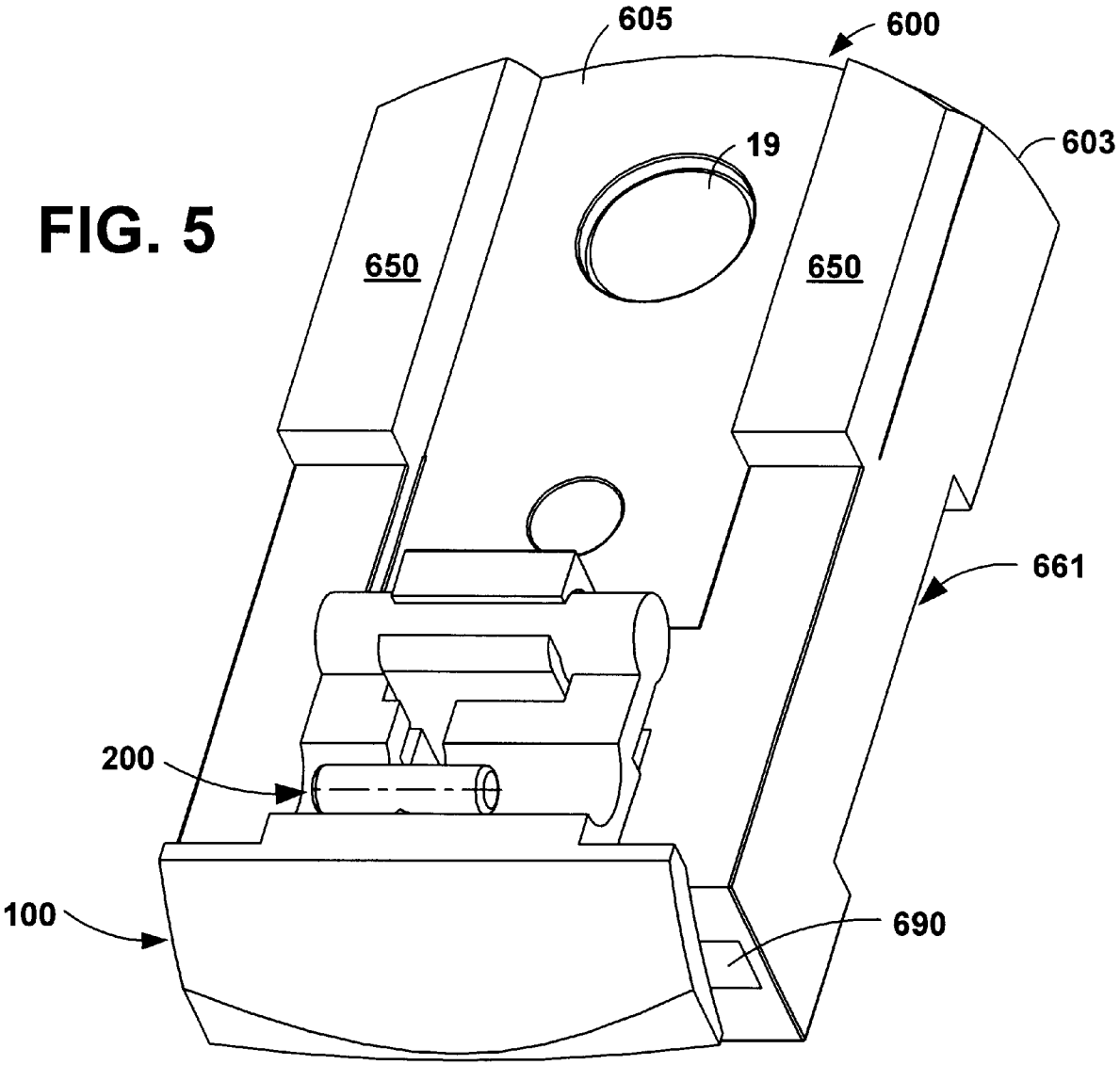
FIG. 5 is a perspective view of the slide assembly of FIG. 4, shown assembled.
Figure 11:
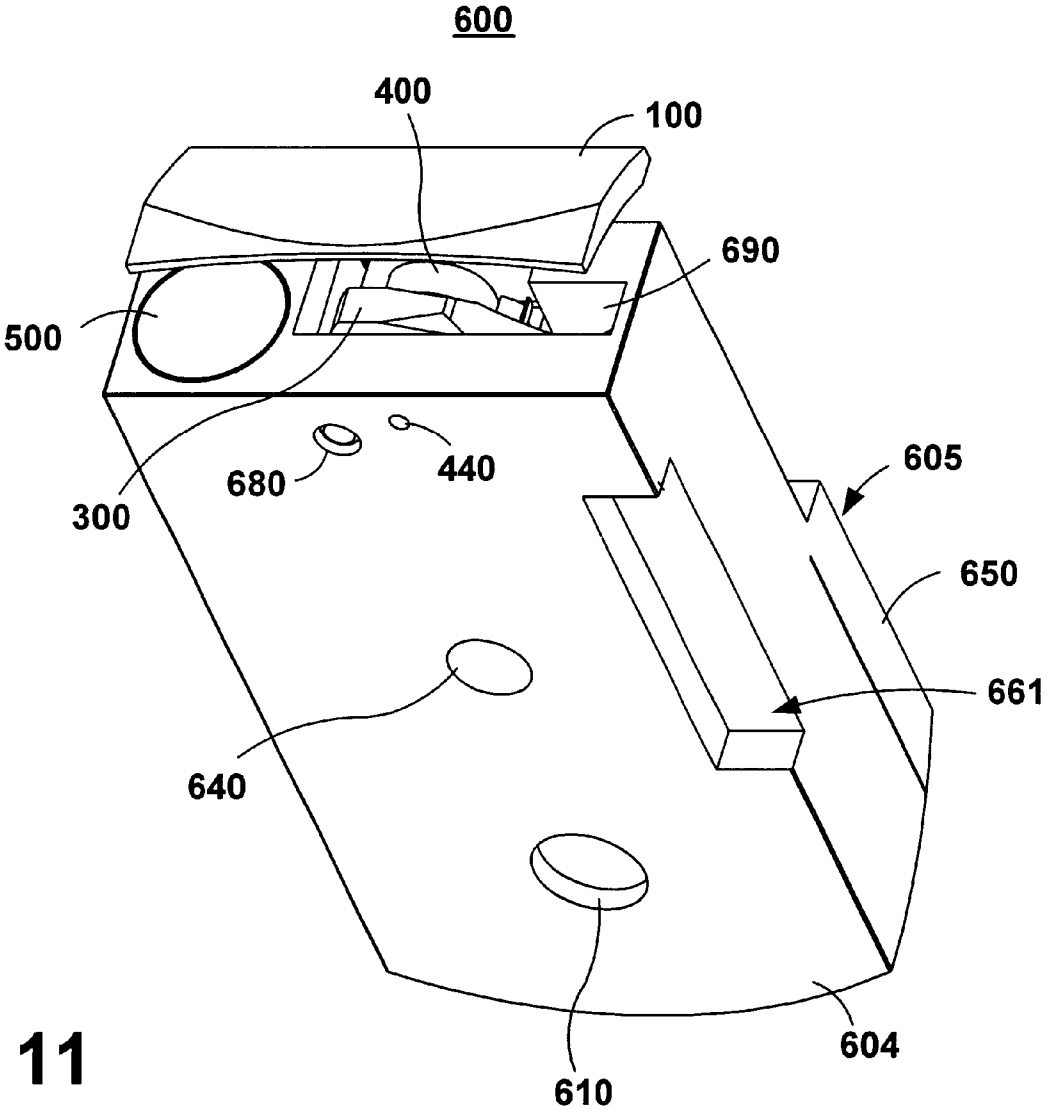
FIG. 11 is a perspective bottom view of the slide body and aerodynamic safety release.

Having described the main components and operation of the fuze 10, the improved slide assembly 70 will now be described in greater detail in connection with FIGS. 4 through 11. With reference to FIGS. 4, 5 and 11, the slide 600 includes several features and retains the remaining components of the slide assembly 70. The slide 600 includes a generally rectangularly shaped slide body 603 which is defined by a base 604 and an upper surface 605. An upright opening 610 (FIG. 4) is formed in the slide body 603, and extends through the upper surface 605 to the base 604, in order to accommodate the main detonator 19 (FIG. 3) and to cause it to be retained against the base 604. The opening 605 is typically as deep as the height of the detonator 19.

A longitudinal blind hole 620 is formed in the slide body 603, and receives the pyrotechnic delay mechanism 500, with the end cap 530 fitted first to be in very close proximity to the main detonator 19, and in contact with the opening 610 via a lateral channel 624. The pyrotechnic delay mechanism 500 is forced fitted or pressed into the hole 620.

A hole 680 extends through the entire depth of the side 665 to nest the safety pin 200. A channel 690 having a generally rectangular cross-section, is formed along one side of the slide 600 to receive the rotational firing pin 300. With reference to FIG. 7, the body 418 of the rotational firing pin 300 includes a crescent shape cutout 727 at one of its side, a generally semi-circular cutout 730 at another end, and a bottom flat face 733.

During assembly, the bottom flat face 733, which is typically in a plane that is orthogonal to the two holes 415 and 425, rests against one side 665 of the channel 661. A side 735 of the rotational firing pin 300 contacts a back surface 670 of the channel 690, so that the pivot pin 420 can be inserted through the rotational spring 400 and through the rotational firing pin 300, and into the hole 440 in the slide 600.

With reference to FIG. 8, the rotational spring 400 includes a spirally wound coil 401 that terminates in an outer hook-shaped end 402 that engages the spiral pin 410. The rotational spring 400 also includes an inner end 404 that engages the pivot pin 420 as described herein.

The rotational spring 400 is nested against an upper flat face 734 of the rotational firing pin 300, and biases against the spiral pin 410 so that the rotational spring 400 is in a pre-loaded condition when the fuze 10 is in the armed position. The crescent cutout 727 is located farthest away from the pyrotechnic delay mechanism 500, and defines a firing pin tip 810. The spring 400 spring loads the rotational firing pin 300 in the firing position, with the firing pin tip 810 at a maximum rotational distance from the initiator 510, so that when the rotational firing pin 300 is released, the pin tip 810 rotates around the pivot pin 420 and strikes the initiator 510, initiating the pyrotechnic delay mechanism 500 as described above.

With reference to FIG. 9, the pivot pin 420 is comprised of three integrally formed sections: a cap 820 that extends into a larger shaft 830, which, in turn, extends into a smaller shaft 840. The smaller shaft 840 is inserted into the hole 440 of the slide 600. The larger shaft 830 is inserted through the rotational spring 400 and the rotational firing pin 300. The cap 820 rests on the surface of the upper rotational spring 400.

With reference to FIG. 10, the spiral pin 410 is cylindrically shaped, and is force fitted into the hole 415 of the rotational firing pin 300. The spiral pin 410 provides a counter-balance support for the rotational spring 400. The spiral pin 410 can be made of the same material as the safety pin 200, for example, metal.

An upright opening 640 extends through the slide body 603, and allows the main firing pin to nest in the slide body 603, and to lock the movement of the slide 600 within the housing 16. Two upright tabs 650 are located on opposite sides of the opening 640, and extend at an angle from and relative to the upper surface 605. The tabs 650 provide a stop to the slide assembly 70 once it has moved into the in-line position with the center axis of the grenade 12 and fuze, by butting against the inner surface of the housing 16.

A pivotal slot 660 (FIG. 4) is provided to accommodate a cylindrically shaped bracket 110 of the aerodynamic safety release 100 as it will be explained later. A channel 670 allows an upright member 210 (FIG. 4) of the safety pin 200 to be inserted in, and retained by the slide 600. A step or channel 661 (FIG. 11) is formed in the slide body 603 to accept a spring similar to the slide spring found in the M223 Fuze.

Figure 6:
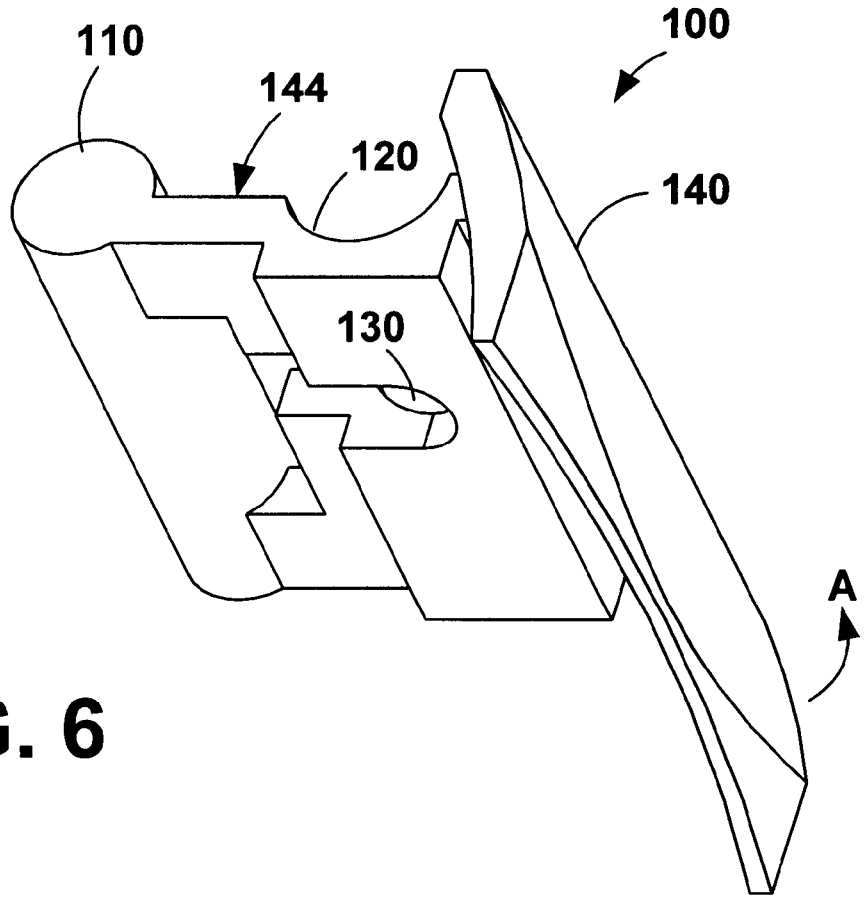
FIG. 6 is an enlarged, perspective, bottom view of an aerodynamic safety release (ASR) forming part of the slide assembly of FIGS. 4 and 5.

With reference to FIG. 6, the aerodynamic safety release 100 is designed to catch the airstream after the grenade 12 has been ejected from its carrier, which causes the safety pin 200 to be lifted up from its nested position in the slide 600. The aerodynamic safety release 100 is comprised of the bracket 110 that fits in the pivotal slot 660 of the slide 600, a wing 140, and a connecting member 144 that connects the bracket 110 and the wing 140.

A lateral member 220 of the safety pin 200 rests in and a lateral groove 120 formed in the connecting member 144 of the aerodynamic safety release 100, to ensure proper seating of the safety pin 200 against the aerodynamic safety release 100. A through opening 130 is generally disposed along a central axis of the connecting member 144, and is preferably positioned in registration with the hole 680 of the slide 600, so that the upright member 210 of the safety pin 200 can be inserted simultaneously through both the opening 130 and the semi-circular hole 730 of the rotational firing pin 300 and into hole 440.

The wing 140 is slightly curved so that it is folded inward toward the slide 600, so that it is deployed in the direction of the arrow A, when it catches the airstream.

The safety pin 200 is generally T-shaped, and is designed to be inserted in the slide 600, as explained earlier, to limit or prevent the movement of the rotational firing pin 300.

It should be understood that the geometry and dimensions of the components described herein may not be to scale, and may be modified within the scope of the invention. The embodiments described herein are included for the purposes of illustration, and are not intended to be the exclusive; rather, they can be modified within the scope of the invention. Other modifications may be made when implementing the invention for a particular application.

What is claimed is:

1. A self-destruct fuze comprising:

a slide assembly including:

a slide;

an aerodynamic safety release secured to the slide;

a safety pin inserted at least in part in the slide;

a rotational firing pin secured to the slide and movable between an armed position and an initiation position, wherein the slide assembly further includes a spiral pin fitted, at least in part, through a hole formed in the rotational firing pin; and a pyrotechnic delay mechanism placed in rotational alignment with the rotational firing pin, so that when the rotational firing pin is in the initiation position it initiates the pyrotechnic mechanism.

2. The self destruct fuze of claim 1, wherein the slide assembly further includes a pivot pin inserted in the rotational firing pin.

3. The self destruct fuze of claim 2, wherein the slide assembly further includes a resilient member; and wherein the pivot pin passes through a resilient member and therefrom through the rotational firing pin, for attachment to the slide.

4. The self destruct fuze of claim 3, wherein the resilient member is a spiral spring that terminates in an inner end and an outer hook-shaped end.

5. A self-destruct fuze Comprising:

a slide assembly including:

a slide;

an aerodynamic safety release secured to the slide;

a safety pin inserted at least in part in the slide;

a rotational firing pin secured to the slide and movable between an armed position and an initiation position; and a pyrotechnic delay mechanism placed in rotational alignment with the rotational firing pin, so that when the rotational firing pin is in the initiation position it initiates the pyrotechnic mechanism, wherein the pyrotechnic delay mechanism includes an initiator and a pyrotechnic delay mix.

6. The self destruct fuze of claim 5, wherein the pyrotechnic delay mechanism further includes an end cap.

7. The self destruct fuze of claim 5, wherein the initiator is made of match tip material or miniature detonator, and receives an initial stimulus from the rotational firing pin in order to initiate the delay pyrotechnic mix.

8. The self destruct fuze of claim 6, wherein the end cap detonates when exposed to a burning pyrotechnic delay mix, and, in turn, initiates a main detonator.

9. The self destruct fuze of claim 8, wherein the slide includes a slide body defined by a base and an upper surface; and wherein the slide body includes an upright opening that accommodates the main detonator.

10. The self destruct fuze of claim 9, wherein the slide body further includes a longitudinal blind hole to the pyrotechnic delay mechanism, with the end cap disposed in proximity to the main detonator.

11. A self-destruct fuze comprising:

a slide assembly including:

a slide;

an aerodynamic safety release secured to the slide;

a safety pin inserted at least in part in the slide;

a rotational firing pin secured to the slide and movable between an armed position and an initiation position, wherein the slide comprises a slide body that includes a channel for receiving the rotational firing pin; and a pyrotechnic delay mechanism placed in rotational alignment with the rotational firing pin, so that when the rotational firing pin is in the initiation position it initiates the pyrotechnic mechanism.

12. The self destruct fuze of claim 11, wherein the rotational firing pin defines a firing pin tip that initiates the pyrotechnic delay mechanism.

13. The self destruct fuze of claim 2, wherein the pivot pin is comprised of three integrally formed sections: a cap, a larger shaft, and a smaller shaft.

* * * * *